US005938137A

United States Patent [19]

Poulson

[11] Patent Number: 5,938,137

[45] Date of Patent: Aug. 17, 1999

[54] CELLULAR PHONE LEASH

[76] Inventor: Harold T. Poulson, 36487 Colbert St., Newark, Calif. 94560

[21] Appl. No.: 09/100,999

[22] Filed: Jun. 22, 1998

[51] Int. Cl.[6] ..... B65H 75/48

[52] U.S. Cl. ..... 242/379.2; 242/404.3

[58] Field of Search ..... 242/379.2, 385.4, 242/384.7, 381.6, 404.3, 404.1; 119/796; 70/456 R; 248/330.1; 224/162, 268, 269; 379/441, 457

[56] References Cited

U.S. PATENT DOCUMENTS

| | | | |
|---|---|---|---|
| 1,120,341 | 12/1914 | Smith | 242/385.4 |
| 1,465,281 | 8/1923 | Morrison | 242/385.4 |
| 2,732,148 | 1/1956 | Lummis | 242/379.2 |
| 3,062,478 | 11/1962 | Adachi | 242/379.2 |
| 3,233,591 | 2/1966 | Rogers et al. | 242/385.4 |
| 4,146,191 | 3/1979 | Cavanaugh | 242/379.2 |
| 4,580,347 | 4/1986 | McKnight | 242/404.3 |
| 5,230,117 | 7/1993 | Johnson et al. | 242/379.2 |
| 5,358,158 | 10/1994 | Darr | 242/404.1 |
| 5,490,805 | 2/1996 | Bredesen | 242/379.2 |
| 5,833,165 | 11/1998 | Paugh | 242/379.2 |

*Primary Examiner*—John M. Jillions
*Attorney, Agent, or Firm*—Linval B. Castle

[57] ABSTRACT

A leash attached to the cell phone case and including a spring retractable leash cord in a housing pivotally attached to the belt will prevent dropping and damage to a cell phone in a case clipped to the belt. The leash housing is pivotally attached to a locking belt hook that cannot easily be accidentally removed.

4 Claims, 1 Drawing Sheet

CELLULAR PHONE LEASH

This invention relates to safety tethers and particularly to a retractable cellular phone cord on a spring biased spool in a housing that is pivotally mounted to a novel belt hook.

BRIEF SUMMARY OF THE INVENTION

The number of cellular telephone users has increased at an astonishing rate over the last few years in all parts of the modern world. Most of the urban population own or plant to own a cellular telephone and, at this time, the cells often reach into rural areas where one may see a farm worker in the field conversing over a cellular telephone.

The trend in cellular telephone design is to minimize the size. The earlier cellular phones were large and bulky and difficult to handle compared with the small, modern cellular phones. These modern phones are often carried by women in their purses and, by men, in a coat pocket, brief case or, usually, in a protective carrying case with a belt clip for attachment to their belt. This belt mounting provides a convenient storage and an easy and quick access to the cellular phone when it rings; however, many phones have been damaged or lost when they have been accidentally dropped while removing or reattaching the phone to the belt.

This invention is for an extendible leash that is attached to the belt and is clipped to the rear surface of the cellular telephone case to prevent the phone from falling in the event it is accidentally dropped. The leash includes a housing that swivels on its belt connection so that the phone user may easily and conveniently use the phone with the leash attached.

Briefly described, the leash includes a strong cord wound on a spring biased spool within a housing which is pivotally connected to a spring steel belt clip. The belt clip may easily be snapped onto the belt but its design prevents it from accidental release.

BRIEF DESCRIPTION OF THE DRAWINGS

In the drawings which illustrate a preferred embodiment of the invention.

DETAILED DESCRIPTION

Figure 1:
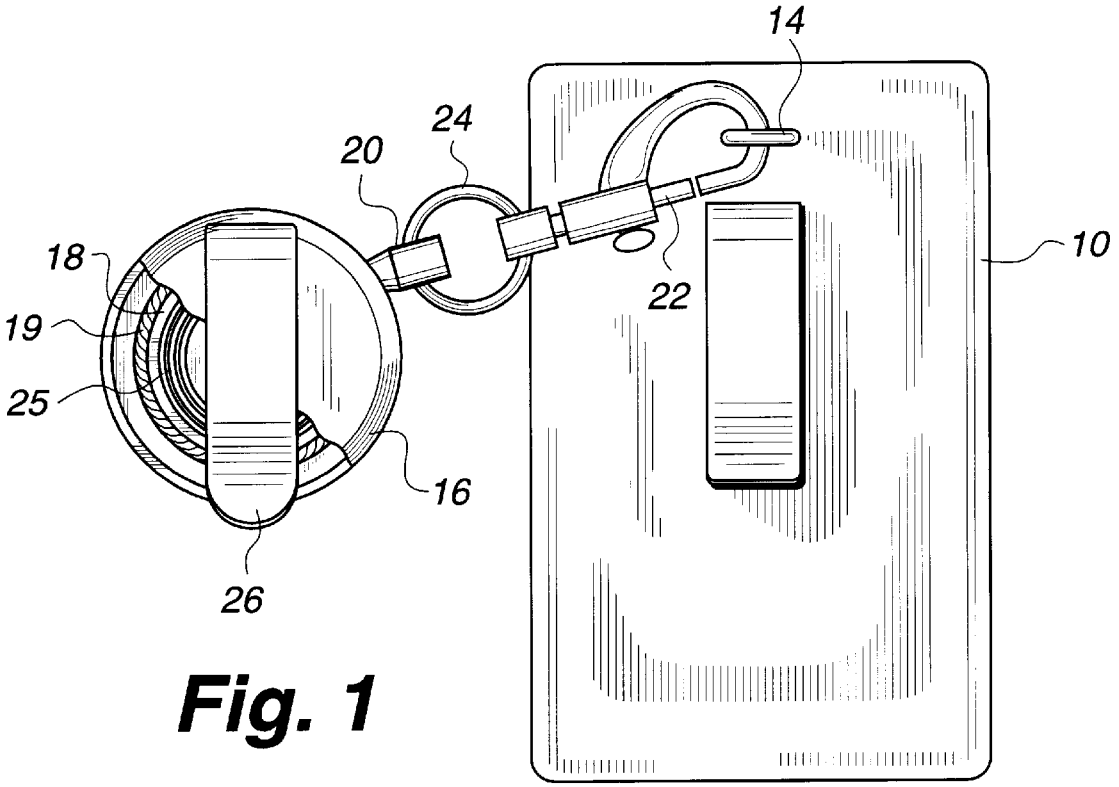
FIG. 1 is a rear elevational view of a cellular telephone with an attached leash partially shown in section.

A cellular telephone case is generally of a soft leather or plastic and covers all sides of the telephone except the front face including the selection buttons, the microphone and the speaker. As illustrated in FIG. 1, the rear surface of the case 10 includes a belt hook 12 and a small eye 14 for attachment of a wrist strap. The leash of this invention is coupled to this eye 14.

As shown in FIG. 1, the leash includes a hollow circular housing 16 containing a concentric circular rotatable spool 18 around the periphery of which is wound a leash cord 19 about thirty inches in length. One end of the leash cord is connected to the spool periphery, the other end is brought out through a ferrule in the edge of the housing and is terminated in the end fixture 20 which is coupled to the snap hook 22 through a ring 24. A spiral spring 25 lies within the spool 18 with an end connected to the center post of the spool to enable the leash cord 19 to be extended and then automatically retracted. A spring steel belt hook 26 is attached to the housing 16 for mounting the cellular telephone leash on a belt adjacent the phone.

Figure 2:
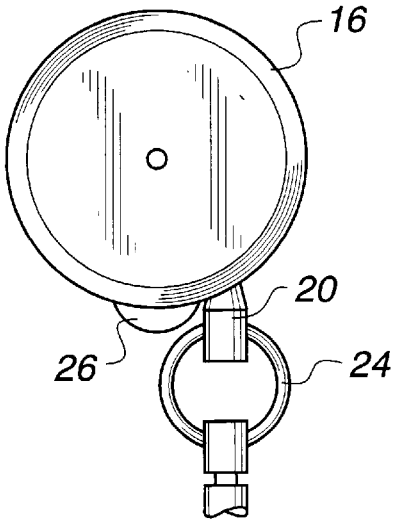
FIG. 2 is a front elevational view of the cellular telephone leash.

FIG. 2 illustrates the front face of the cellular telephone leash housing 16. Notice that the cord end fixture now is hanging free from the housing 16 whereas in FIG. 1 it was in a high position. This is caused by the swiveling of the housing 16.

Figure 3:
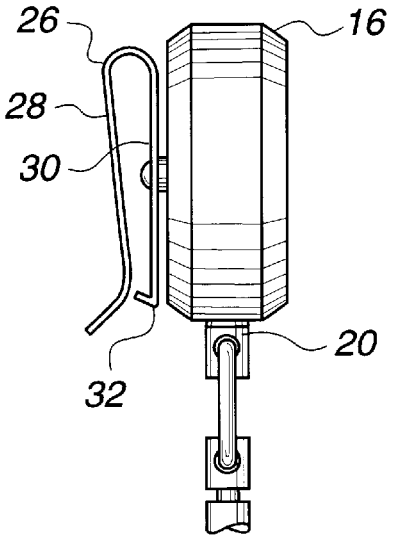
FIG. 3 is a side view showing the leash pivotally attached to a belt clip.

FIG. 3 is a side elevational view of FIG. 2. The belt hook 26 is shown connected to the central shaft through the housing 16. In a preferred embodiment this central shaft is a flat headed screw journalled within a bushing sleeve spanning the side walls within the housing so that the housing 16 may spin freely around its axis.

The belt hook 26 is of spring steel and is formed to be easily attached to and removed from the belt but extremely difficult to accidentally dislodge from the belt. The belt hook is formed from a single piece bent near its center to form two spaced parallel legs 28, 30. The outer leg 28 is bent slightly outward near its end so that it may easily attach over a belt. The inner leg 30 which is attached near its center to the swiveling housing 16 is first squared at the end and then abruptly bent outward near its end to contact the outer leg 28 so that the bent portion 32 forms an angle with the straight portion of the leg 30 of preferably less than 85 degrees. This acute angle locks a belt into the belt hook. It can be removed easily by lifting the end of the outer leg 28.

I claim:

1. A leash for a cellular telephone case that is normally suspended by a clip on the user's belt and has an eye for attachment of a wrist strap, said leash comprising:

a hollow circular housing containing a spool of leash cord, said leash cord having one end passing through the edge of said housing and being removable attached to the eye on the cellular telephone case, said circular housing having an axis;

a spiral spring within said housing and attached to said axis and said spool for automatically winding said leash cord;

a belt hook pivotally attached to said housing; and means in said belt hook for preventing accidental disengagement from a belt.

2. The leash for a cellular telephone case claimed in claim 1 wherein said belt hook is pivotally connected on said axis on an external surface of said housing.

3. The leash for a cellular telephone case claimed in claim 1 wherein said means for preventing accidental disengagement comprises a spring steel belt clip formed with parallel outer and inner legs with the end of the inner leg being bent into an acute angle to contact the outer leg.

4. A leash adapted to be attached to a cellular telephone case, said leash comprising:

a hollow circular housing containing a rotatable spool with a leash cord wound thereon, said leash cord having one end attached to said spool and one end passing through a hole in the edge of said housing and terminating in a snap hook, said rotatable spool being rotatable around a central axis of said housing;

spring means within said housing and attached to said axis and said spool for applying a leash cord rewinding bias to said spool; and a belt hook pivotally attached to said housing at said axis, said belt hook being of a resilient metal with front and rear portions adapted to surround a belt, said rear portion being bent up against said front portion to form a lock which prevents accidental removal of said hook from a belt.

* * * * *